US010046832B1

(12) United States Patent
Brookins

(10) Patent No.: US 10,046,832 B1
(45) Date of Patent: Aug. 14, 2018

(54) POWER CLEAT SYSTEM

(71) Applicant: Keith Donald Brookins, Miami, FL (US)

(72) Inventor: Keith Donald Brookins, Miami, FL (US)

( * ) Notice: Subject to any disclaimer, the term of this patent is extended or adjusted under 35 U.S.C. 154(b) by 5 days.

(21) Appl. No.: 15/433,126

(22) Filed: Feb. 15, 2017

(51) Int. Cl.
*B63B 21/00* (2006.01)
*B63B 21/04* (2006.01)
*B63B 21/08* (2006.01)

(52) U.S. Cl.
CPC ..... *B63B 21/045* (2013.01); *B63B 21/00* (2013.01); *B63B 21/04* (2013.01); *B63B 21/08* (2013.01)

(58) Field of Classification Search
CPC ..... B63B 21/00; B63B 21/04; B63B 21/08
USPC ..... 114/218, 230.11
See application file for complete search history.

(56) References Cited

U.S. PATENT DOCUMENTS 7,131,387 B1 * 11/2006 Czipri ..... B63B 21/045 114/218
8,025,431 B1 * 9/2011 Burke ..... B63B 21/045 114/218
8,033,233 B2 * 10/2011 Strong ..... B63B 21/045 114/218
9,919,768 B1 * 3/2018 Brookins ..... B63B 21/04

* cited by examiner

*Primary Examiner* — Lars A Olson
(74) *Attorney, Agent, or Firm* — Albert Bordas, P.A.

(57) ABSTRACT

A power cleat system having a cleat assembly, a cleat base assembly, a backer plate assembly, a cylinder assembly, and a guide support assembly. The cleat assembly has a top end, a base, and guide shafts. The cleat base assembly has a drain groove, a base, threaded sections protruding from the base, and linear bearings. The backer plate assembly has a backer plate, backer plate holes, and a backer plate housing hole. The cylinder assembly has a cylinder, exterior and interior threading, a fitting, a spring, a piston, a piston rod, a piston cylinder cap, and a piston screw. The guide support assembly has mounting flanges, a base with a hole, and a base screw. The power cleat system further has a bezel gasket assembly, and an electrical assembly that has a light source to illuminate the cleat assembly and/or the cleat base assembly.

18 Claims, 5 Drawing Sheets

POWER CLEAT SYSTEM

BACKGROUND OF THE INVENTION

1. Field of the Invention

The present invention relates to sea vessel and marina cleats, and more particularly, to power cleat systems.

2. Description of the Related Art

The present application is a continuation-in-part of pending U.S. patent application Ser. No. 15/428,838, filed on Feb. 9, 2017, which is hereby incorporated by reference.

SUMMARY OF THE INVENTION

The present invention is a power cleat system, comprising a cleat assembly, a cleat base assembly, a backer plate assembly, a cylinder assembly, and a guide support assembly.

The cleat assembly comprises a top end, a base and guide shafts that each comprise an end and a flat side respectively. The cleat base assembly comprises a drain groove, a base, threaded sections protruding from the base, and linear bearings. The power cleat system further comprises a bezel gasket assembly. The backer plate assembly comprises a backer plate, backer plate holes, and a backer plate housing hole.

The cylinder assembly comprises a cylinder, exterior and interior threading, a fitting, and first and second ends. The cylinder assembly further comprises a spring, a piston, a piston rod, a piston cylinder cap, first and second seals, and a piston screw. The guide support assembly comprises first and second mounting flanges, a base having a hole, and a base screw. The piston rod is secured within the guide support assembly by the base screw, and the piston cylinder cap tightens onto the interior threading of the cylinder. The first and second mounting flanges are fixed to the guide shafts through respective flange holes.

The cylinder assembly elevates and retracts the cleat assembly from the cleat base assembly. The spring is compressed by the piston when a gas or fluid is introduced through the fitting, causing the guide support assembly to elevate the cleat assembly. The spring retracts the cleat assembly onto the cleat base assembly when the gas or fluid is extracted through the fitting.

The power cleat system further comprises an electrical assembly, having a light source to illuminate the cleat assembly and/or the cleat base assembly as it relates to a trip hazard. In a preferred embodiment, the light source may be a LED module or a bulb.

It is therefore one of the main objects of the present invention to provide a power cleat system.

It is another object of this invention to provide a power cleat system designed for docks and vessels that present as a low profile cleat or group of cleats that can be remotely actuated, causing them to raise, an elevated position, and present as cleats ready for use.

It is another object of this invention to provide a power cleat system comprising a cleat assembly that defaults to a down, also defined as retracted, position and can be manually lifted for use if needed.

It is another object of this invention to provide a power cleat system designed to retract on demand or with a timeout feature.

It is another object of this invention to provide a power cleat system designed to reduce risks as a trip or snag hazard.

It is another object of this invention to provide a power cleat system designed with safety and style by a location revealing light.

It is another object of this invention to provide a power cleat system designed to shed water rather than pool it.

It is another object of this invention to provide a power cleat system that is lighted by an electrical assembly.

It is another object of this invention to provide a power cleat system that is raised and lowered remotely.

It is another object of this invention to provide a power cleat system, which is of a durable and reliable construction.

It is yet another object of this invention to provide such a device that is inexpensive to manufacture and maintain while retaining its effectiveness.

Further objects of the invention will be brought out in the following part of the specification, wherein detailed description is for the purpose of fully disclosing the invention without placing limitations thereon.

BRIEF DESCRIPTION OF THE DRAWINGS

With the above and other related objects in view, the invention consists in the details of construction and combination of parts as will be more fully understood from the following description, when read in conjunction with the accompanying drawings in which.

DETAILED DESCRIPTION OF THE PREFERRED EMBODIMENT

Figure 1:
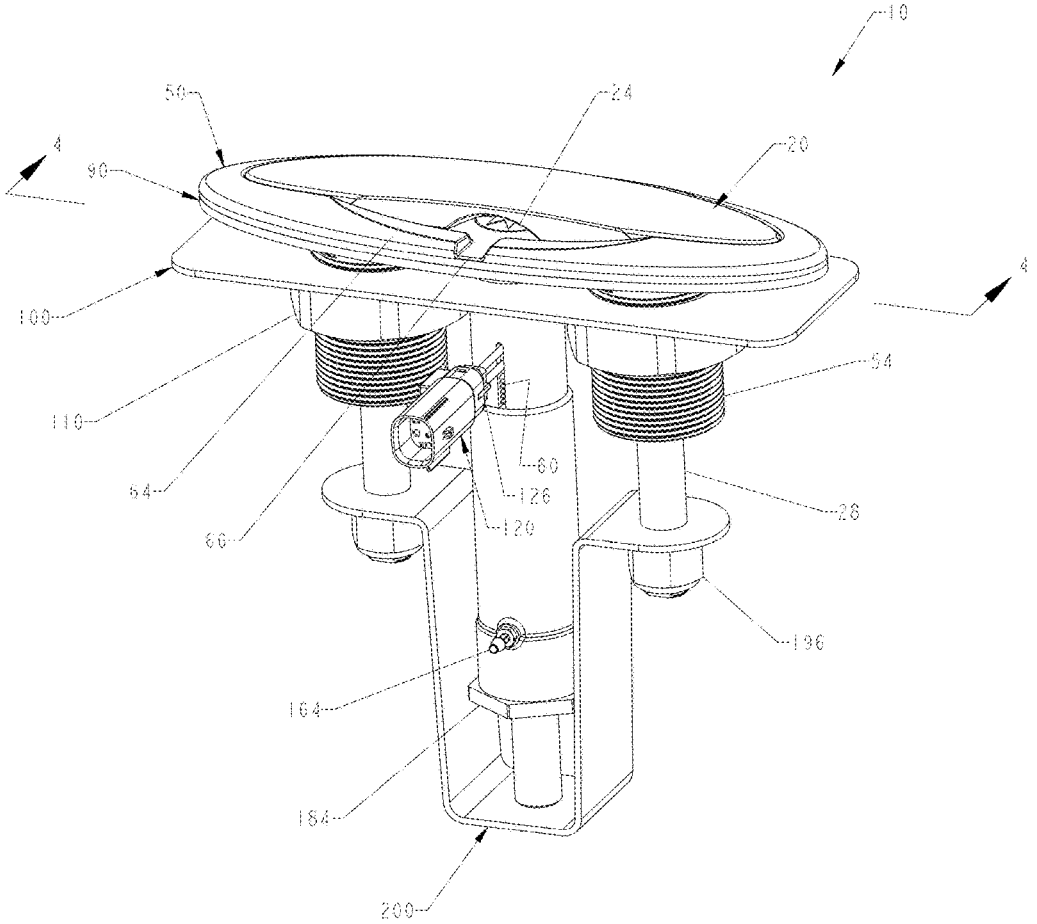
FIG. 1 represents an isometric view of the present invention in a retracted configuration.

Referring now to the drawings, the present invention is a power cleat system and is generally referred to with numeral 10. It can be observed that it basically includes cleat assembly 20, cleat base assembly 50, backer plate assembly 100, cylinder assembly 150, and guide support assembly 200.

Figure 2:
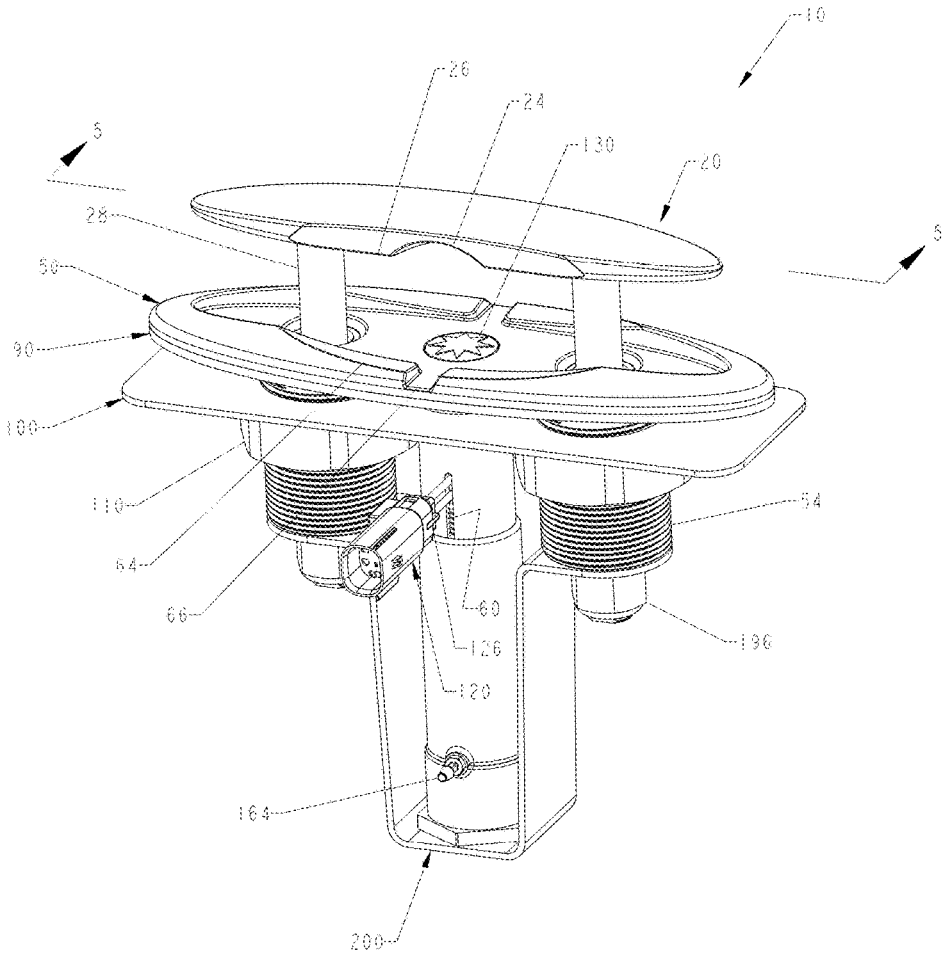
FIG. 2 represents an isometric view of the present invention in an extracted configuration.

As seen in FIGS. 1 and 2, present invention 10 is a cleat system designed for docks and vessels that present as a low profile cleat or group of cleats that can be remotely actuated, causing them to raise, an elevated position, and present as cleats ready for use. Present invention 10 can be made of marine grade stainless steel and is designed to take up a small amount of space, fitting easily inside gunnels and bows of vessels.

Present invention 10 therefore comprises cleat assembly 20, which can be elevated from or retracted onto cleat base assembly 50. Once mounted onto docks or vessels, not seen, bezel gasket assembly 90, backer plate assembly 100, cylindrical assembly 150, guide support assembly 200, and electrical assembly 120 are coupled and positioned below cleat base assembly 50.

Cleat assembly 20 defaults to a down, also defined as retracted, position and can be manually lifted for use if needed. Furthermore, designed to retract on demand or with a timeout feature, cleat assembly 20 returns to its low profile.

In the down, also defined as retracted, position the low profile of cleat assembly 20 presents reduced risks as a trip or snag hazard.

Figure 3:
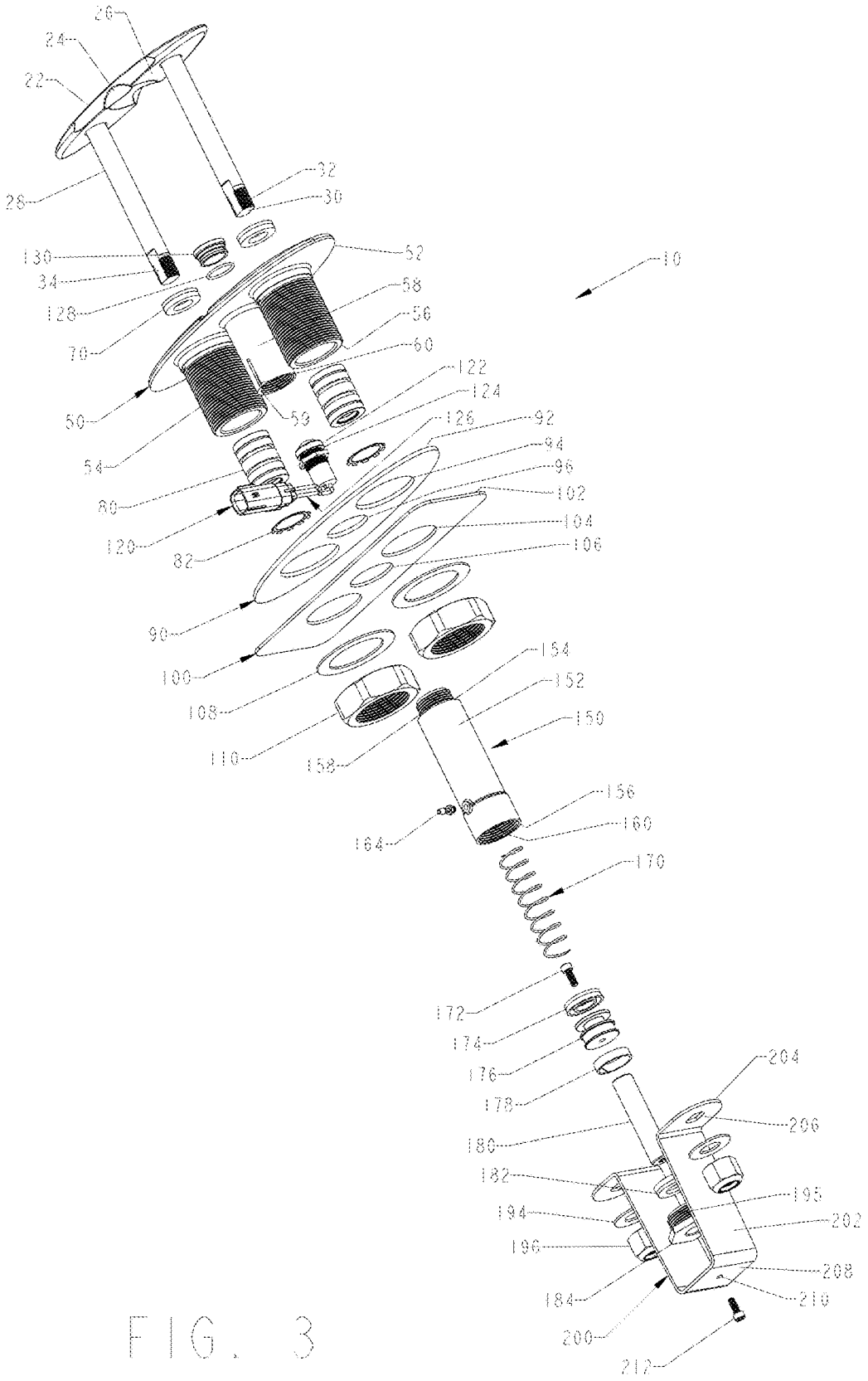
FIG. 3 is an exploded view of the present invention.

Cleat assembly 20 and/or cleat base assembly 50 are lighted by electrical assembly 120 having light source 122, seen in FIG. 3. In a preferred embodiment, light source 122 may be a light-emitting diode (LED) module or a bulb. Light source 122 illuminates to reveal whether cleat assembly 20 is in the down, also defined as retracted, position, or in the up, also defined as elevated position. Light source 122 further illuminates to reveal a cleat assembly 20 location for safety and docking convenience, and also as it relates to a trip hazard. Conversely, dock mounted cleats will illuminate a vessel gunnel revealing its adjacent location.

In addition, as seen in FIG. 2, cleat base assembly 50 has scallop cuts 64, and drain grooves 66 for water drainage from cleat base assembly 50. Cleat base assembly 50 therefore is designed to shed water rather than pool it.

As seen in FIG. 3, present invention 10 comprises cleat assembly 20, cleat base assembly 50, backer plate assembly 100, cylinder assembly 150, and guide support assembly 200.

Cleat assembly 20 comprises top end 22, notch 24, base 26, and guide shafts 28. Guide shafts 28 comprise first and second ends 30, flat sides 32, and threaded sections 34 respectively. The formation of each guide shaft 28 and its respective flat side 32 forms a "D" shape.

Cleat base assembly 50 comprises base 52, electrical housing 58 comprising slit 60, and protruding from base 52 are threaded sections 54 having respective ends 56. In addition, cleat base assembly 50 comprises shaft seals 70, linear bearings 80 and retaining rings 82 that are all housed within threaded sections 54.

Power cleat system 10 further comprises bezel gasket assembly 90 comprising gasket 92, hole 94, and housing hole 96. Backer plate assembly 100 comprises backer plate 102, backer plate holes 104, and backer plate housing hole 106. Backer plate assembly 100 and bezel gasket assembly 90 are coupled to cleat base assembly 50 with washers 108 and nuts 110.

Cylinder assembly 150 comprises cylinder 152, exterior threading 158, interior threading 160, fitting 164, first end 154 and second end 156. The cylinder assembly 150 further comprises spring 170, piston 176, piston rod 180, piston cylinder cap 184, first seal 174, second seal 182, wiper seal 178, and piston screw 172.

Guide support assembly 200 comprises sidewalls 202, first and second mounting flanges 204, base 208 having hole 210, and base screw 212. Piston rod 180 is secured within guide support assembly 200 by base screw 212, and exterior threading 195 of piston cylinder cap 184 tightens onto interior threading 160 of cylinder 152. Mounting flanges 204 are fixed to guide shafts 28 through respective flange holes 206 with washers 194 and nuts 196.

Cylinder assembly 150 elevates and retracts cleat assembly 20 from cleat base assembly 50. Spring 170 is compressed by piston 176 when a gas or fluid is introduced through fitting 164, causing guide support assembly 200 to elevate cleat assembly 20. Spring 170 retracts cleat assembly 20 onto cleat base assembly 50 when the gas or fluid is extracted through fitting 164. It is noted that exterior threading 158 of cylinder assembly 150 fastens onto interior threading 59 of electrical housing 58.

Power cleat system 10 further comprises electrical assembly 120 that has light source 122 to illuminate cleat assembly 20 and/or cleat base assembly 50. Electrical assembly 120 further comprises light source gasket 124, wire leads 126, o-ring 128 and lens 130. Safety and style of power cleat system 10 is enhanced by location revealing light illuminating from light source 122 of electrical assembly 120. It is noted that light source 122 is designed to be visible regardless of cleat assembly 20 being up or down. In any position, the underside of cleat assembly 20 is designed to split the light source to sides, through drain grooves 66, seen in FIG. 2, to illuminate the area perpendicular to that cleat assembly 20 providing accurate and easy alignment from afar. Furthermore, vessel location is achieved by splitting the up light from light source 122, as an example 90 degrees, throwing a locating beam of light which illuminates an area parallel to the vessel and allowing a vessel operator to stop adjacent to where the vessel will be tied.

Figure 4:
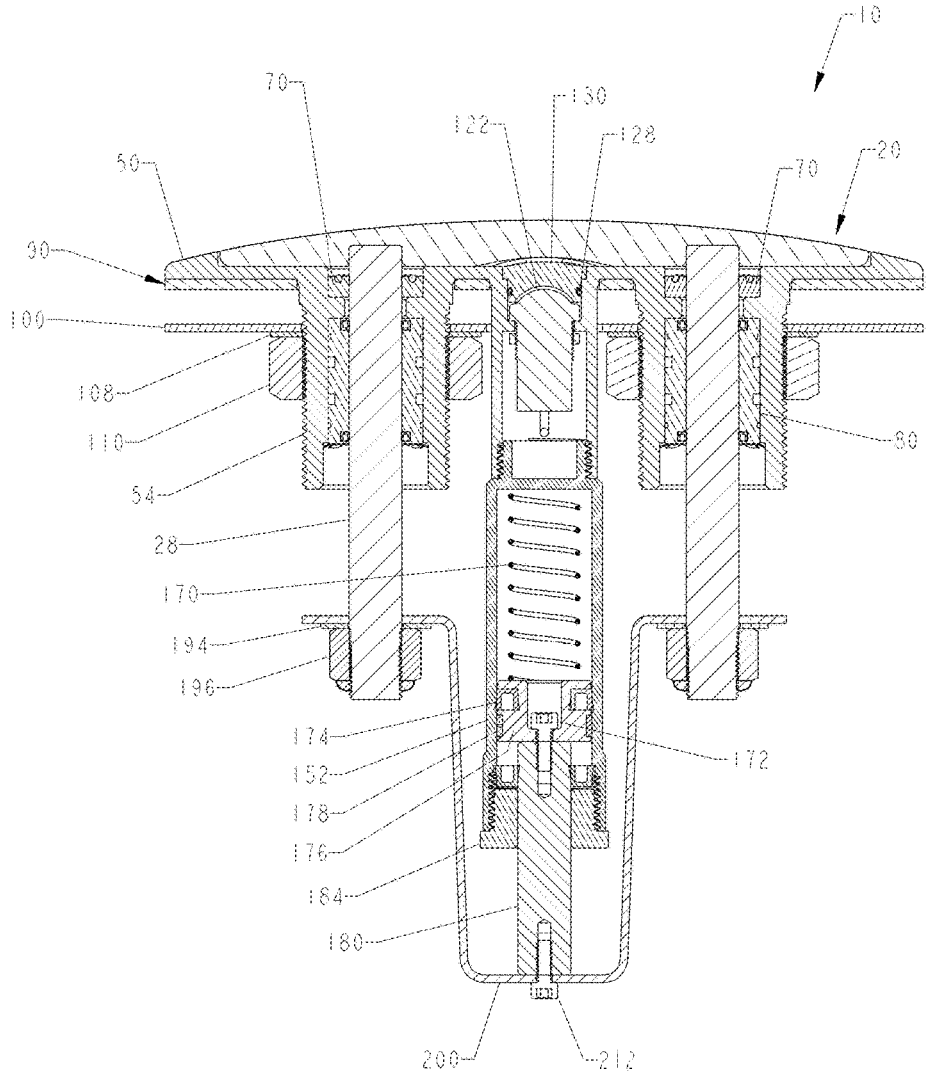
FIG. 4 is a cut view taken along the lines 4-4 as seen in FIG. 1.
Figure 5:
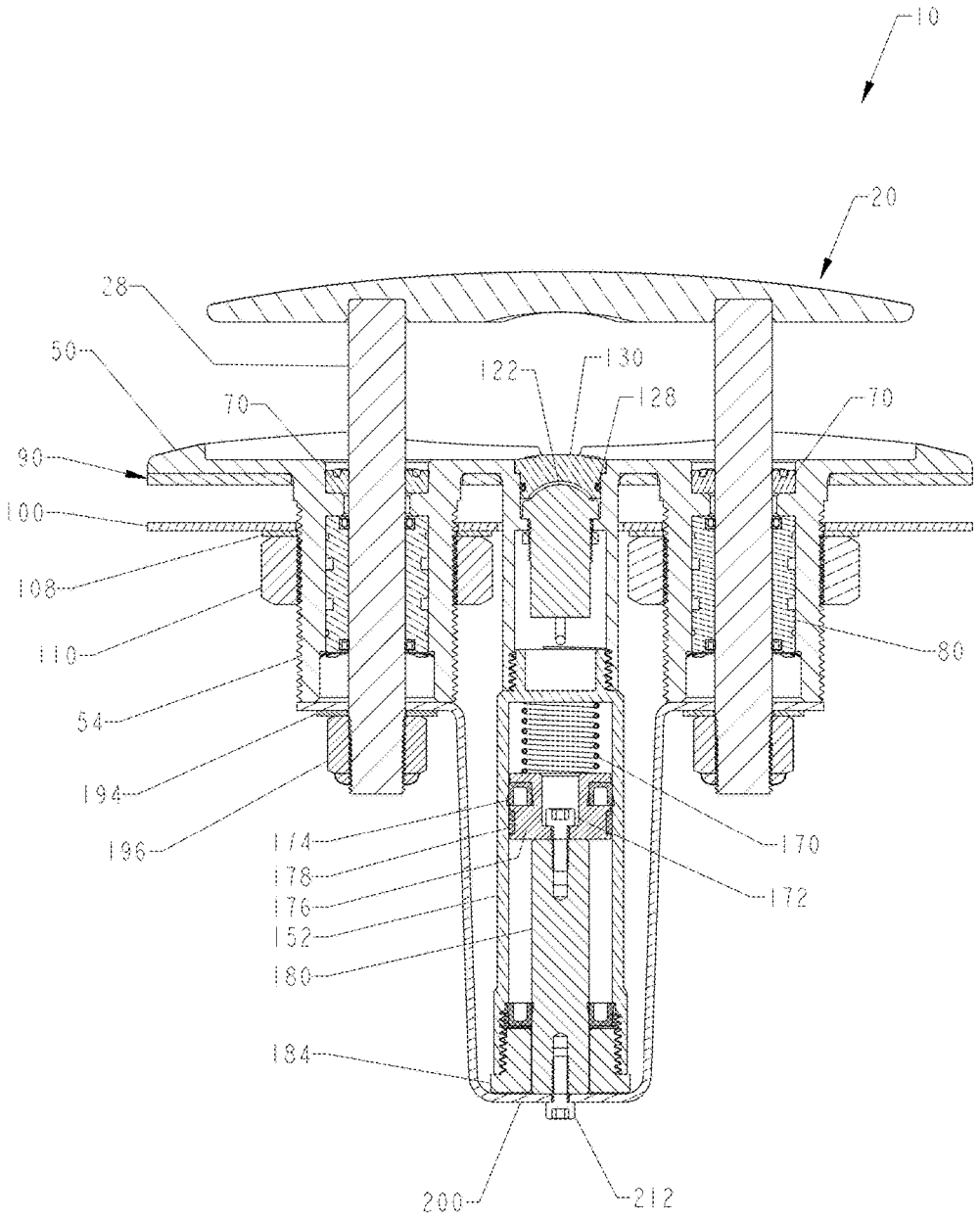
FIG. 5 is a cut view taken along the lines 5-5 as seen in FIG. 2.

As seen in FIGS. 4 and 5, shaft seals 70, bezel gasket assembly 90, and o-ring 128 prevent water from leaking through present invention 10.

In operation, present invention 10 is a power cleat system, a pop up style cleat that is raised and lowered remotely. Present invention 10 can be remotely controlled from a single act of a user. Present invention 10 is designed to be stronger than conventional cleats of a same size. Cleat assembly 20 and cleat base assembly 50 are low profile in the down, also defined as retracted, position and work at any angle or orientation. As an example, present invention 10 may be side mounted onto a pier or dock.

Present invention 10 further comprises means to adjust speeds to retract cleat assembly 20 onto cleat base assembly 50, and to elevate cleat assembly 20 from cleat base assembly 50. The means to adjust speeds to retract and elevate cleat assembly 20 comprises piston 176, spring 170, applied pressures and flow rate of charge and discharge.

Present invention 10 can work safely at very low pressures such as 10 psi, as an example, and can be set to move fast, snapping to attention, or slow for quiet repositioning. Present invention 10 can be controlled manually by keychain radio frequency (RF) remote. Manual control can activate present invention 10 by a button, lever, push pull, or any number of valve configurations including a switch located somewhere in the vessel, not seen, presumably the helm, where it is easily accessed. The manual control can operate all cleat assemblies 20 and can provide control to individual cleat assembly 20 groups by adding a second switch. One such example is by separately controlling the port and starboard sides. A control button may be, as an example, a toggle or push-pull. The toggle is pulled to the up position to lift cleat assemblies 20 and pushed down to lower cleat assemblies 20, while push-pull is configured to pull out to raise cleat assemblies 20 and depress to lower cleat assemblies 20.

Present invention 10 is therefore watertight, lighted, powered, remotely actuated, strong, works at any angle/orientation, has means for speed control, and may use an open or closed, air or hydraulic loop, and is quiet. In addition, present invention 10 is a stronger cleat design because of the absence of the need for detent notching of the guide shafts 28.

The foregoing description conveys the best understanding of the objectives and advantages of the present invention. Different embodiments may be made of the inventive concept of this invention. It is to be understood that all matter disclosed herein is to be interpreted merely as illustrative, and not in a limiting sense.

What is claimed is:

1. A power cleat system, comprising:

A) a cleat assembly comprising guide shafts, each of said guide shafts comprises a flat side;

B) a cleat base assembly;

C) a backer plate assembly;

D) a cylinder assembly; and

E) a guide support assembly.

2. The power cleat system set forth in claim 1, further characterized in that said cylinder assembly elevates said cleat assembly from said cleat base assembly.

3. The power cleat system set forth in claim 1, further characterized in that said cylinder assembly retracts said cleat assembly onto said cleat base assembly.

4. The power cleat system set forth in claim 1, further characterized in that said cleat assembly comprises a top end and a base.

5. The power cleat system set forth in claim 1, further characterized in that each of said guide shafts comprises a respective end.

6. The power cleat system set forth in claim 1, further characterized in that said cleat base assembly comprises a drain groove, a base, and threaded sections protruding from said base.

7. The power cleat system set forth in claim 1, further comprising linear bearings.

8. The power cleat system set forth in claim 1, further comprising a bezel gasket assembly.

9. The power cleat system set forth in claim 1, further characterized in that said backer plate assembly comprises a backer plate, backer plate holes, and a backer plate housing hole.

10. The power cleat system set forth in claim 1, further characterized in that said cylinder assembly comprises a cylinder, exterior and interior threading, a fitting, and first and second ends.

11. The power cleat system set forth in claim 10, further characterized in that said cylinder assembly comprises a spring, a piston, a piston rod, a piston cylinder cap, first and second seals, and a piston screw.

12. The power cleat system set forth in claim 11, further characterized in that said guide support assembly comprises first and second mounting flanges, a base with a hole, and a base screw.

13. The power cleat system set forth in claim 12, further characterized in that said piston rod is secured within said guide support assembly by said base screw, and said piston cylinder cap tightens onto said interior threading of said cylinder.

14. The power cleat system set forth in claim 12, further characterized in that said first and second mounting flanges are fixed to said guide shafts through respective flange holes.

15. The power cleat system set forth in claim 11, further characterized in that said spring is compressed by said piston when a gas or fluid is introduced through said fitting, causing said guide support assembly to elevate said cleat assembly.

16. The power cleat system set forth in claim 11, further characterized in that said cylinder assembly comprises a spring to retract said cleat assembly onto said cleat base assembly when a gas or fluid is extracted through said fitting.

17. The power cleat system set forth in claim 1, further comprising an electrical assembly.

18. The power cleat system set forth in claim 17, further characterized in that said electrical assembly comprises a light source to illuminate said cleat assembly and/or said cleat base assembly as it relates to a trip hazard.

* * * * *